US005842634A

United States Patent [19]

Kieler

[11] Patent Number: 5,842,634

[45] Date of Patent: Dec. 1, 1998

[54] FOLDING CUP

[76] Inventor: Wayne Clinton Kieler, 1670 E. 35th Ave., Vancouver, British Columbia, Canada, V5P 1B3

[21] Appl. No.: 634,398

[22] Filed: Apr. 18, 1996

[51] Int. Cl.[6] ..... B65D 5/02; B65D 5/462

[52] U.S. Cl. ..... 229/405; 229/4.5; 229/116; 229/402

[58] Field of Search ..... 229/4.5, 116, 400, 229/402, 405

[56] References Cited

U.S. PATENT DOCUMENTS

D. 261,847 11/1981 Yamamoto .
4,284,205 8/1981 Hirata .
4,391,366 7/1983 Hirata .

FOREIGN PATENT DOCUMENTS

WO 95/02353 1/1995 France .
1713549 1 2/1992 U.S.S.R. .

*Primary Examiner*—Gary E. Elkins
*Attorney, Agent, or Firm*—Oyen Wiggs Green & Mutala

[57] ABSTRACT

A folding cup is disclosed which folds from an open pyramidal shape to a flattened folded state for easy storage. The edges of the pyramid shape form flexible hinges, and the cup can be manufactured from a planar plastic or paper blank.

4 Claims, 3 Drawing Sheets

FOLDING CUP

TECHNICAL FIELD

The invention relates to beverage containers such as cups which can be folded from an open state which can be used for drinking, to a flattened, folded state.

BACKGROUND ART

Frequently individuals may require a cup in order to consume a beverage in situations where a cup may not normally be available. For example, water may be available in public washrooms or the like but no containers may be available to facilitate taking a drink of water. In the case of the handicapped, or children, the individual may not be able to readily reach the source of water, even if the source is a fountain designed for drinking from. Other examples of situations where a cup is useful but may not be readily available is in an automobile, or at an amateur sporting event where there may be a source of water or other beverages but no supply of containers. A standard cup is generally too bulky to be conveniently carried by an individual on his or her person. Consequently there is a need for a beverage container which can be readily carried by an individual in a flattened state.

DISCLOSURE OF INVENTION

The present invention provides a folding cup formed from a planar blank. The folding cup comprises four planar, generally triangular sides, each side having a vertex meeting at a common point with the vertices of the other three sides, each side having two side edges and an upper edge, each side meeting an adjacent side along a common side edge, said common side edges thereby forming four flexible hinges, whereby said cup is adapted to be folded from an open position wherein adjacent sides form angles of approximately 90 degrees, to a folded state in which adjacent sides lie in parallel relationship.

BRIEF DESCRIPTION OF DRAWINGS

In drawings which illustrate a preferred embodiment of the invention.

BEST MODE(S) FOR CARRYING OUT THE INVENTION

Figure 1:
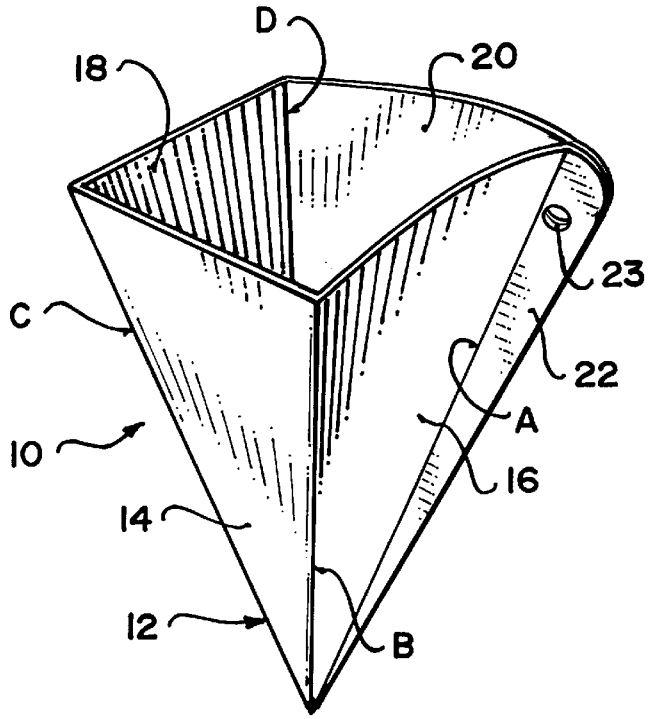
FIG. 1 is a perspective view of the invention in open condition.

With reference to the drawings, the folding cup of the invention is shown in assembled and open state in FIG. 1, designated by reference numeral 10. It has a pyramidal body

Figure 2:
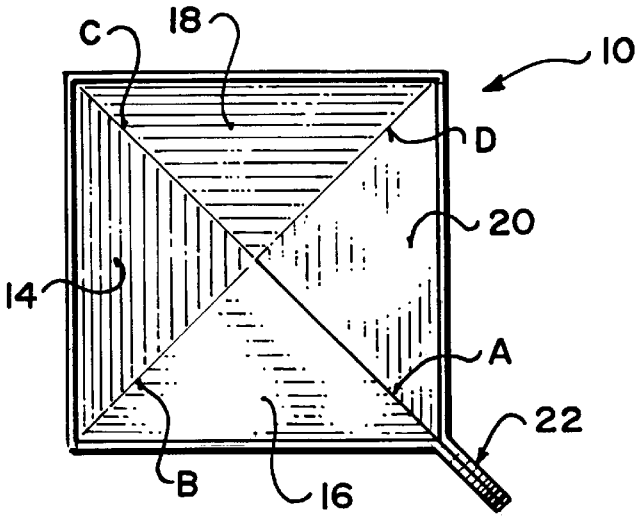
FIG. 2 is a top view of the invention in open condition.
Figure 6:
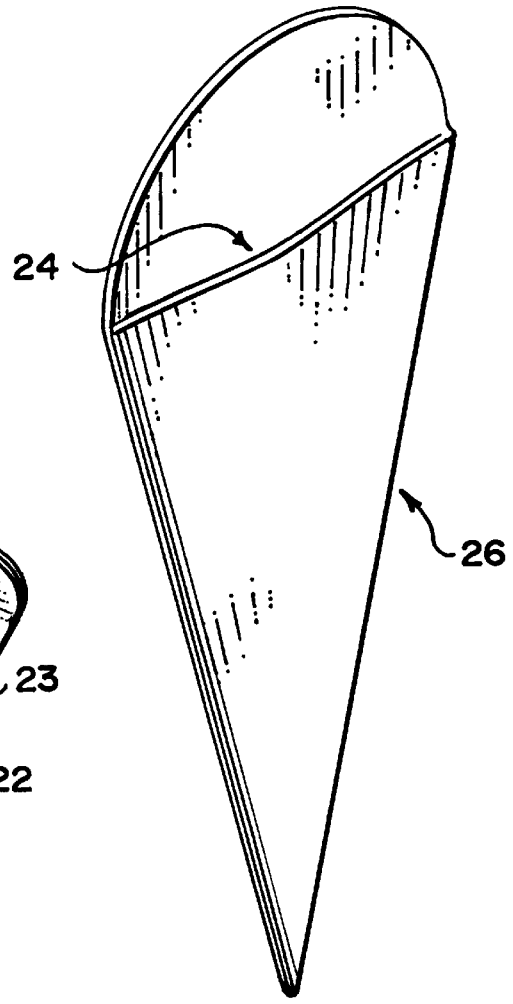
FIG. 6 is a perspective view of a carrying case for the invention in folded condition.
Figure 3:
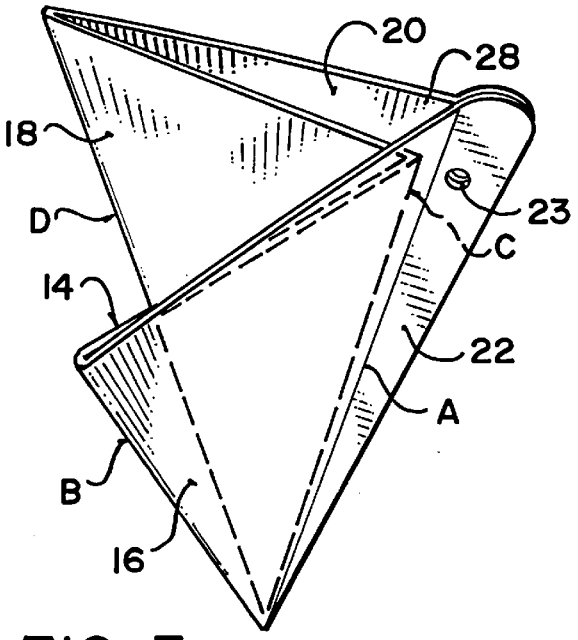
FIG. 3 is a perspective view of the invention in partly folded condition with a portion of the handle cut away for ease of illustration.
Figure 4:
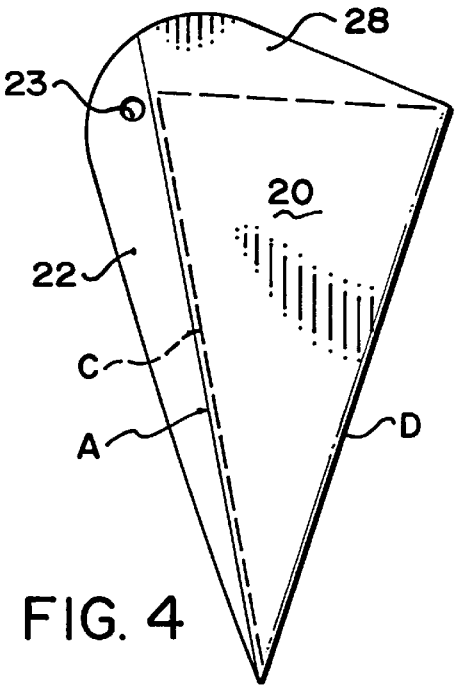
FIG. 4 is an elevational view of the invention in fully folded condition.

12 formed of four planar, generally triangular sides 14, 16, 18, 20 which preferably have equal widths at their top edges, to form a square in top view as shown in FIG. 2. Sides 14, 16, 18, 20 form a liquid-containing reservoir 22. Sides 14, 16 meet along edge B. Sides 14, 18 meet along edge C. Sides 18, 20 form edge D. Sides 16, 20 form edge A. Handle 22 is secured along edge A. Edges A, B, C, D are flexible and permit folding of the cup 10. As shown in FIGS. 3, 4 edge C is folded inwardly towards edge A, and edges B and D are then moved together so that side 14 lies against side 18. The folded cup is shown in FIG. 4. The folded cup can then be stored in pocket 24 of carrying case 26 shown in FIG. 6.

The rim 28 of cup 10 can be raised towards the handle 22 along the upper edges of sides 16 and 20 to facilitate drinking from an area along edge C.

Figure 5:
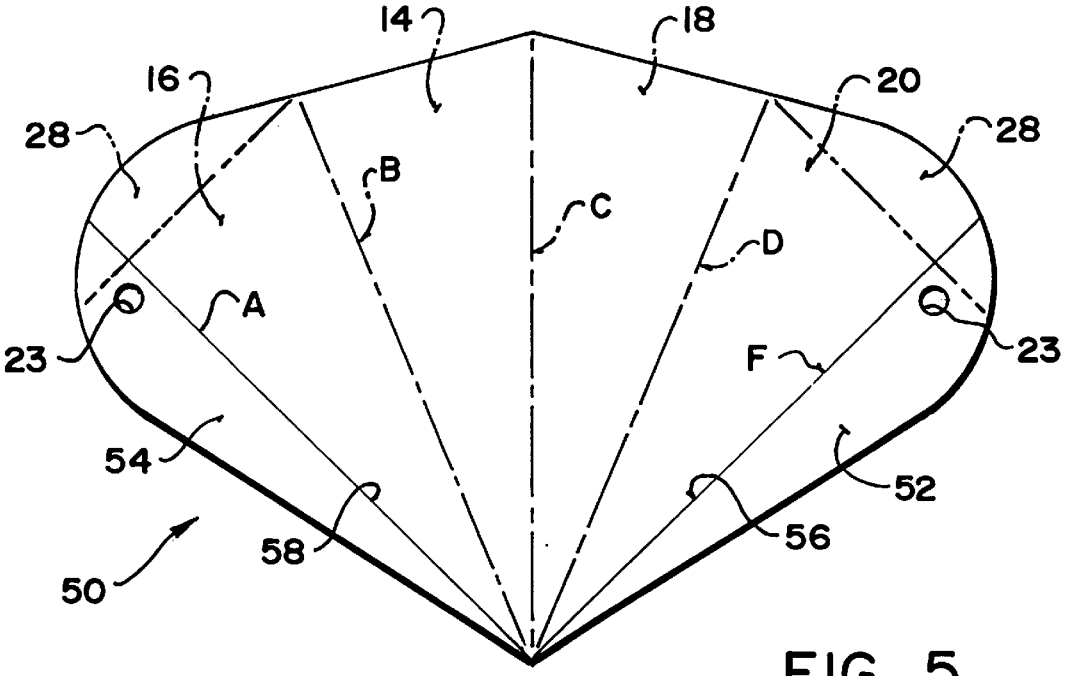
FIG. 5 is a plan view of the blank of the invention in open condition.

Cup 10 can be manufactured from a plastic blank 40 shown in FIG. 5. Blank 50 has flexible "living hinge" type joints along edges A, B, C, D. Handle 22 is formed from two tabs 52, 54 which are secured along flexible hinge edges 56, 58. The faces of tab 52 and 54 are heat sealed together and edges 56, 58 are similarly heat sealed along their entire length to form a water tight seal. A hole 23 can be provided in handle 22 to attach a key chain, for example.

As an alternate form of manufacture, the folding cup of the invention could be manufactured from paper, as are conical paper cups currently. In that case, blank 50 would be the same as shown in FIG. 5 except that tab 54 is removed. Folding edges or seams A, B, C, D are formed by pre-folding the blank. Tab 52 is extended over seam A to overlap edge A and is secured by waterproof glue or adhesive to side 16. Tab 52 is then folded back to form a single piece handle, and the cup can be folded and unfolded as previously described.

Figure 7:
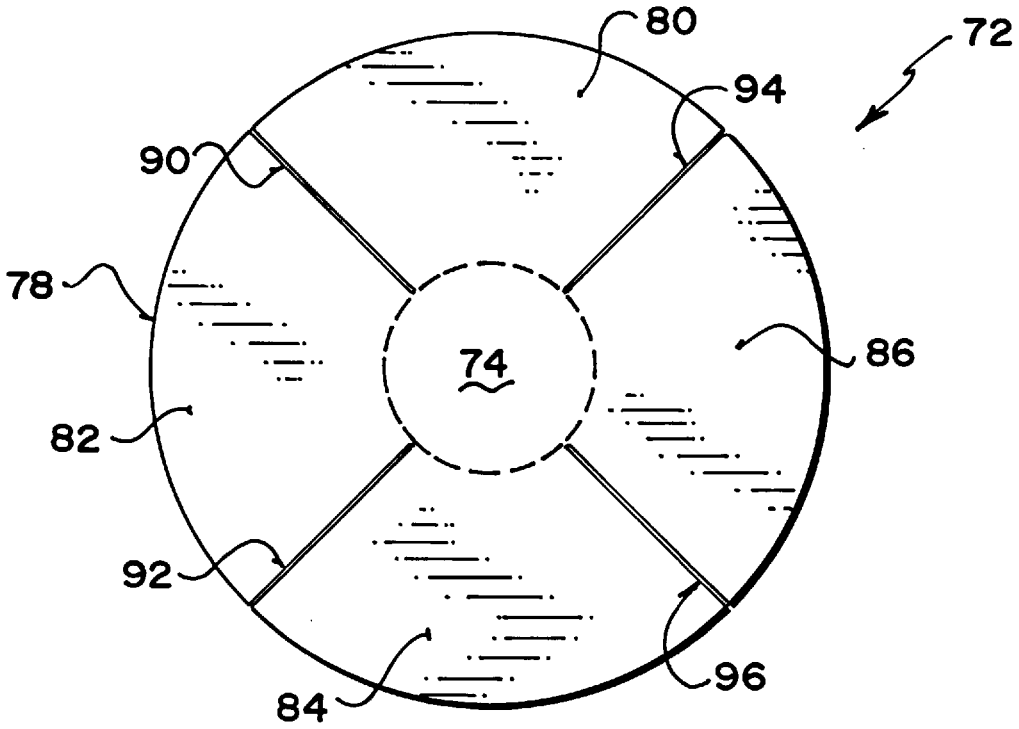
FIG. 7 is a perspective view of a blank for a second embodiment of the invention in open condition.
Figure 8:
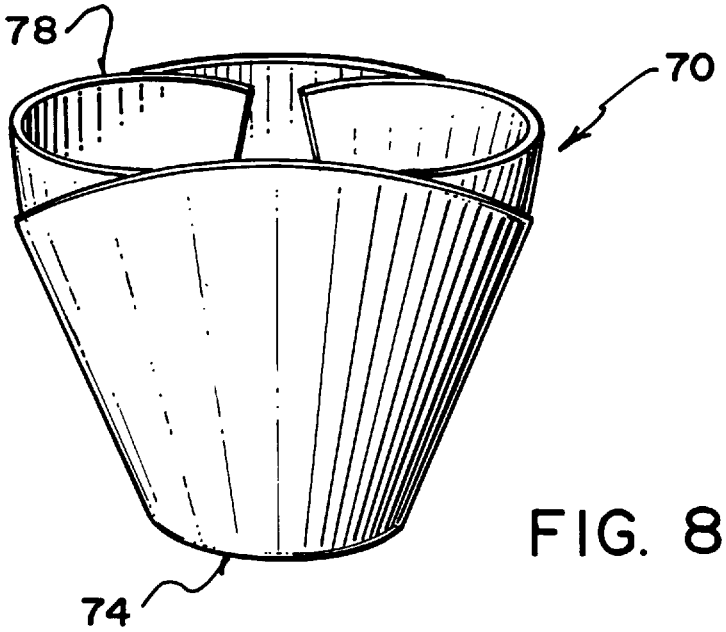
FIG. 8 is a perspective view of the embodiment shown in FIG. 7 in unfolded condition.

FIG. 7 and 8 illustrate a variant of the invention in which the formed cup 70 is conical, formed from a circular planar blank 72 of a foldable plastic, with four radial cuts 90, 92, 94, 96 extending from the rim 78 to the circumference of the central circular base 74 to form a conical cup from four quadrants 80, 82, 84, 86. The four quadrants 80, 82, 84, 86 are slid relative to each other and glued or heat welded in place to form the conical cup 70 with base 74. The cup 70 can then be folded for storage by pressing the sides flat one against the other, folding up base 74, and folding the resultant flattened element in two.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A blank for making a folding cup, said folding cup comprising four planar, generally triangular sides, each side having a vertex meeting at a common point with the vertices of the other three sides, each side having an upper edge, each side meeting an adjacent side along a common fold line, said common fold lines thereby forming four flexible hinges, whereby said cup is adapted to be folded from an open configuration wherein adjacent sides form angles of approximately 90 degrees, to a folded configuration in which all four sides lie in parallel, superposed relationship, and further comprising handle means formed along one of said common fold lines;

wherein said blank comprises a planar piece of waterproof material having an upper edge, a lower vertex, right and left side edges, a first flexible fold line extending centrally from said vertex to a central point on said upper edge, second and third flexible fold lines radiating from said vertex to second and third points on said upper edge spaced to either side of said central point, and fourth and fifth flexible fold lines radiating from said vertex to fourth and fifth points on said upper edge spaced to either side of said second and third points respectively, whereby said fourth and fifth flexible fold lines form with said right and left edges respectively first and second handle-forming sections, each having an upper surface, the upper surface of said first handle-forming section being adapted to be secured to said upper surface of said second handle-forming section, thereby forming said handle means, and said first, second and third flexible fold lines hereby forming three flexible hinges of said folding cup and said fourth and fifth flexible fold lines thereby forming the fourth flexible hinge of said folding cup.

2. The blank of claim 1 wherein said waterproof material is plastic or paper.

3. The blank of claim 1 wherein said handle means are adapted for attaching to a key chain.

4. The folding cup of claim 1 wherein said upper edges adjacent said handle means are raised.

* * * * *